US010164343B2

(12) United States Patent
Jan et al.

(10) Patent No.: US 10,164,343 B2
(45) Date of Patent: Dec. 25, 2018

(54) COMMUNICATION DEVICE

(71) Applicant: Wistron NeWeb Corp., Hsinchu (TW)

(72) Inventors: Cheng-Geng Jan, Hsinchu (TW); Chieh-Sheng Hsu, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 156 days.

(21) Appl. No.: 15/480,180

(22) Filed: Apr. 5, 2017

(65) Prior Publication Data

US 2018/0183134 A1 Jun. 28, 2018

(30) Foreign Application Priority Data

Dec. 22, 2016 (TW) ..... 105142653 A

(51) Int. Cl.

| | |
|---|---|
| ***H01Q 21/24*** | (2006.01) |
| ***H01Q 13/10*** | (2006.01) |
| ***H01Q 15/14*** | (2006.01) |
| ***H01Q 9/04*** | (2006.01) |
| ***H01Q 3/24*** | (2006.01) |
| ***H01Q 1/42*** | (2006.01) |
| ***H01Q 9/40*** | (2006.01) |
| ***H01Q 21/26*** | (2006.01) |
| ***H01Q 21/28*** | (2006.01) |

(52) U.S. Cl.

CPC ..... *H01Q 13/10* (2013.01); *H01Q 1/42* (2013.01); *H01Q 3/24* (2013.01); *H01Q 9/0421* (2013.01); *H01Q 9/40* (2013.01); *H01Q 15/14* (2013.01); *H01Q 21/24* (2013.01); *H01Q 21/26* (2013.01); *H01Q 21/28* (2013.01)

(58) Field of Classification Search

CPC ..... H01Q 13/10; H01Q 21/28; H01Q 21/26; H01Q 21/24; H01Q 9/40; H01Q 1/42; H01Q 15/14; H01Q 3/24; H01Q 9/0421

USPC ..... 343/702

See application file for complete search history.

(56) References Cited

U.S. PATENT DOCUMENTS

| | | | | |
|---|---|---|---|---|
| 7,636,064 | B2 * | 12/2009 | Shi | H01Q 1/1257 343/700 MS |
| 8,354,972 | B2 * | 1/2013 | Borja | H01Q 1/38 343/700 MS |
| 9,472,846 | B2 * | 10/2016 | Ng | H01Q 9/0421 |
| 9,838,067 | B2 * | 12/2017 | Suh | H01Q 9/0421 |

* cited by examiner

*Primary Examiner* — Brian K Young

(74) *Attorney, Agent, or Firm* — McClure, Qualey & Rodack, LLP

(57) ABSTRACT

A communication device includes an antenna system. The antenna system at least includes a dual-polarized antenna, a reflector, a PIFA (Planar Inverted F Antenna), and a fork structure. The reflector is configured to reflect the radiation energy from the dual-polarized antenna. The PIFA is separated from the reflector. The fork structure is positioned between the reflector and the PIFA, and is coupled to the reflector or the PIFA.

20 Claims, 8 Drawing Sheets

COMMUNICATION DEVICE

CROSS REFERENCE TO RELATED APPLICATIONS

This Application claims priority of Taiwan Patent Application No. 105142653 filed on Dec. 22, 2016, the entirety of which is incorporated by reference herein.

BACKGROUND OF THE INVENTION

Field of the Invention

The disclosure generally relates to a communication device, and more particularly, to a communication device and an antenna system therein.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements that allow mobile devices in a room to connect to the Internet at high speeds. However, since indoor environments have serious signal reflection and multipath fading, wireless access points should process signals in a variety of polarization directions and from a variety of transmission directions simultaneously. Accordingly, it has become a critical challenge for antenna designers to design a high-gain, multi-polarized antenna in the limited space of a wireless access point.

BRIEF SUMMARY OF THE INVENTION

In an exemplary embodiment, the disclosure is directed to a communication device including an antenna system. The antenna system includes a first dual-polarized antenna, a first reflector, a first PIFA (Planar Inverted F Antenna), and a first fork structure. The first reflector is configured to reflect radiation energy from the first dual-polarized antenna. The first PIFA is separated from the first reflector. The first fork structure is positioned between the first reflector and the first PIFA, and is coupled to the first reflector or the first PIFA.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
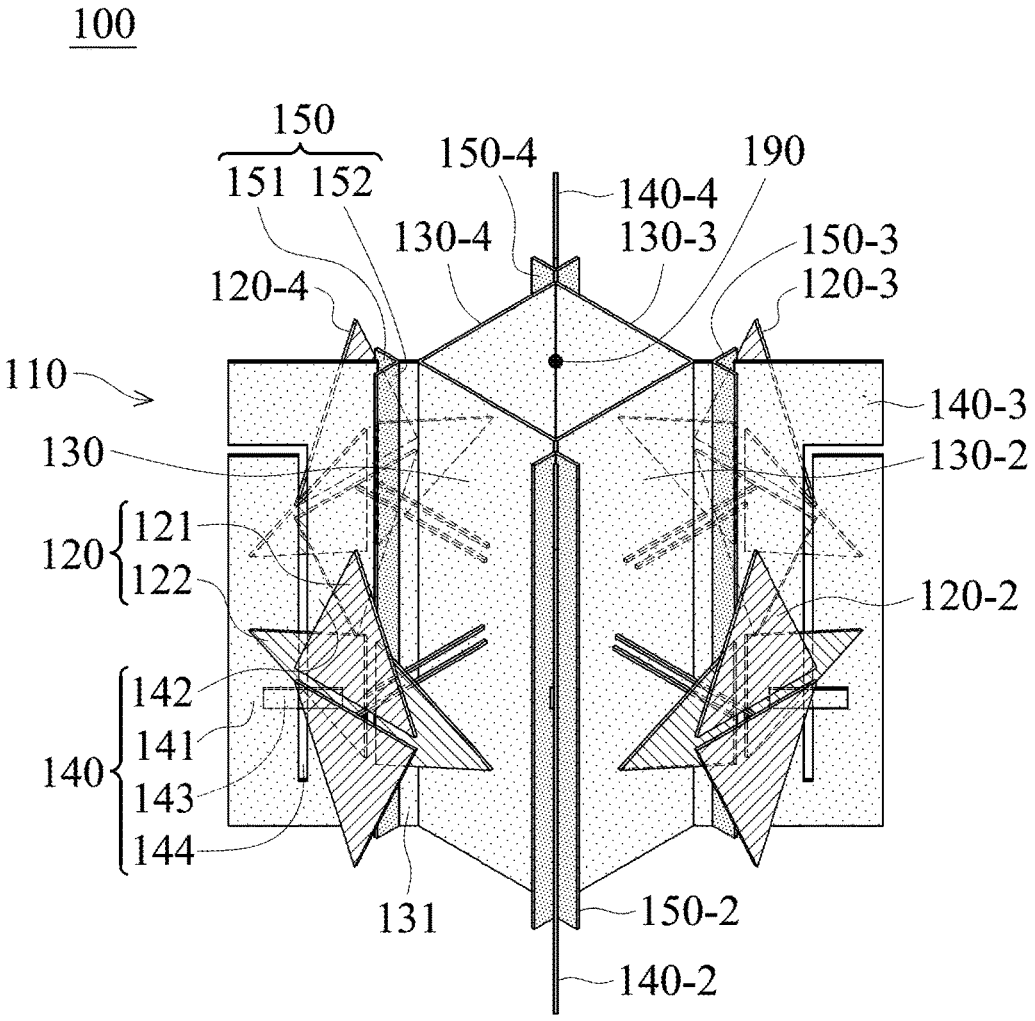
FIG. 1A is a perspective view of a communication device according to an embodiment of the invention.
Figure 1B:
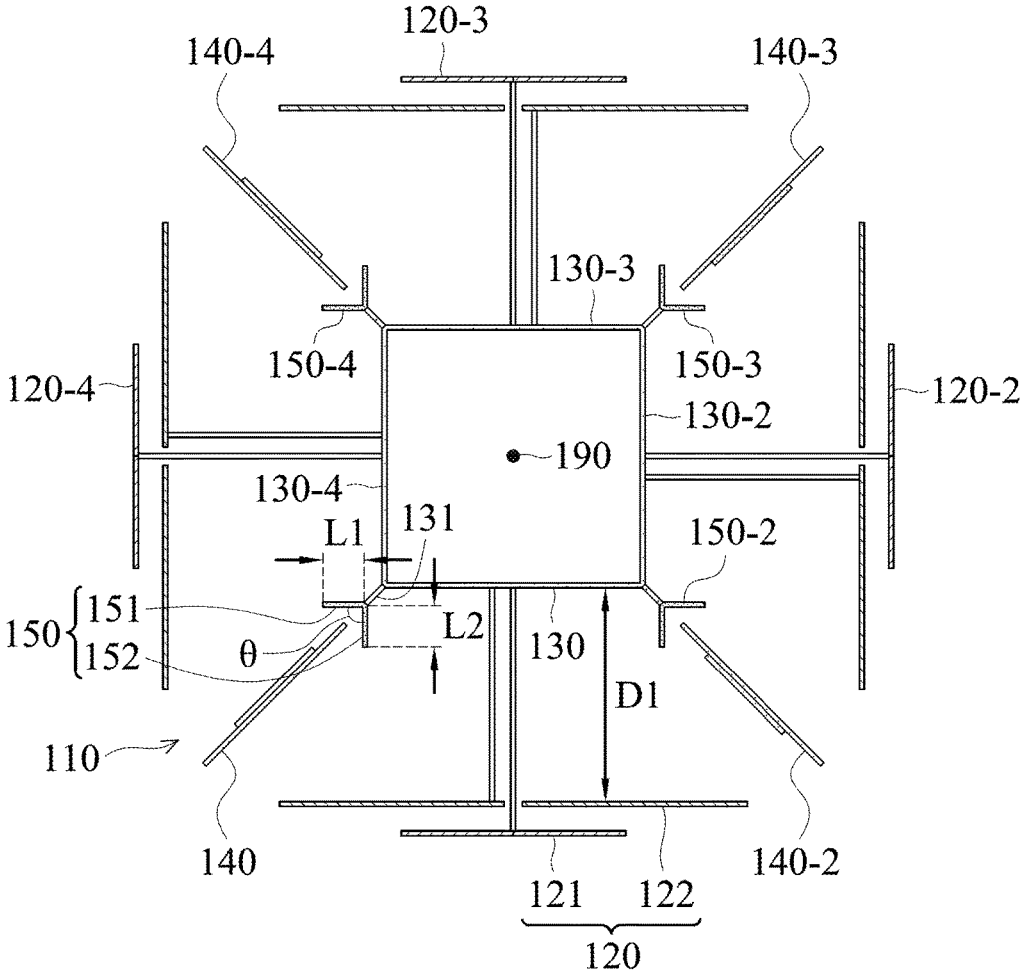
FIG. 1B is a top view of a communication device according to an embodiment of the invention.
Figure 1C:
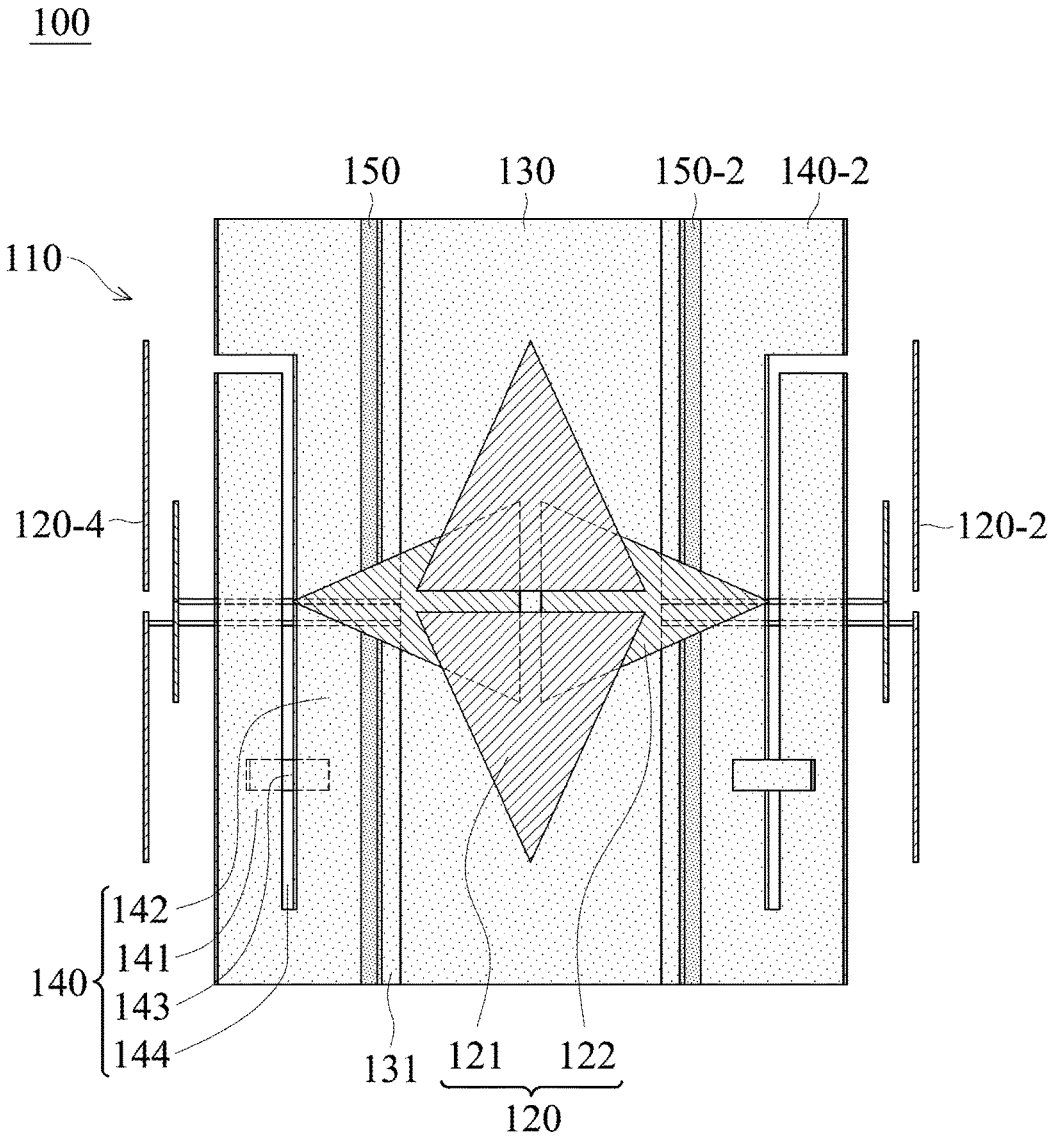
FIG. 1C is a side view of a communication device according to an embodiment of the invention.

FIG. 1A is a perspective view of a communication device 100 according to an embodiment of the invention. FIG. 1B is a top view of the communication device 100 according to an embodiment of the invention. FIG. 1C is a side view of the communication device 100 according to an embodiment of the invention. Please refer to FIG. 1A, FIG. 1B, and FIG. 1C together. The communication device 100 can be applied in a wireless access point. As shown in FIG. 1A, FIG. 1B, and FIG. 1C, the communication device 100 at least includes an antenna system 110. The antenna system 110 at least includes a first dual-polarized antenna 120, a first reflector 130, a first PIFA (Planar Inverted F Antenna) 140, and a first fork structure 150.

The first dual-polarized antenna 120 includes a first dipole antenna element 121 and a second dipole antenna element 122. The first dipole antenna element 121 and the second dipole antenna element 122 may be perpendicular to each other, so as to achieve the dual-polarized characteristics. For example, if the first dipole antenna element 121 has a first polarization direction and the second dipole antenna element 122 has a second polarization direction, the first polarization direction may be perpendicular to the second polarization direction. In order to increase the operation bandwidth, the first dipole antenna element 121 and the second dipole antenna element 122 may be diamond-shaped dipole antenna elements. However, the invention is not limited to the above. In other embodiments, the first dual-polarized antenna 120 includes two different-type antenna elements, such as two monopole antenna elements or two patch antenna elements.

The first reflector 130 has a pyramidal shape (hollow structure) with a wide top opening and a narrow bottom plate. The wide top opening of the first reflector 130 faces the first dual-polarized antenna 120. Specifically, the wide top opening of the first reflector 130 has a relatively large rectangular shape, and the narrow bottom plate of the first reflector 130 has a relatively small rectangular shape. The first reflector 130 is configured to eliminate the back-side radiation of the first dual-polarized antenna 120 and to enhance the front-side radiation of the first dual-polarized antenna 120. Accordingly, the antenna gain of the first dual-polarized antenna 120 is increased. The invention is not limited to the above. In alternative embodiments, the first reflector 130 has a lidless triangular cylindrical shape or a lidless circular cylindrical shape (hollow structure), and its top opening still faces the first dual-polarized antenna 120, without affecting the performance of the invention.

The first PIFA 140 is disposed adjacent to the first reflector 130, but is completely separated from the first reflector 130. Specifically, the first PIFA 140 includes a radiation element 141, a grounding element 142, and a feeding element 143. A slot 144 is formed between the radiation element 141 and the grounding element 142. The slot 144 substantially has an L-shape, and it can at least partially separate the radiation element 141 from the grounding element 142. The feeding element 143 may be a coaxial cable. The feeding element 143 extends across the slot 144 and is coupled to the radiation element 141, so as to excite the first PIFA 140. In some embodiments, the radiation element 141 and the grounding element 142 of the first PIFA 140 and an edge 131 of the first reflector 130 are all disposed on the same plane. The proposed design can suppress undesired mutual coupling between the first PIFA 140 and the first reflector 130 because the first PIFA 140 and the first reflector 130 are disconnected from each other.

In some embodiments, the first PIFA 140 covers a low-frequency band from 746 MHz to 894 MHz, and the first dual-polarized antenna 120 covers a high-frequency band from 1710 MHz to 2360 MHz. Therefore, the antenna system 110 of the invention can support at least the multi-band and wideband operation of LTE (Long Term Evolution) Band 13/Band 5/Band 4/Band 2/Band 66/Band 30. Furthermore, the multi-polarized property of the antenna system 110 can help to solve the problem of multipath fading in indoor environments.

In order to increase the size of the effective reflector in the high-frequency band, the invention adds a first fork structure 150 between the first reflector 130 and the first PIFA 140. The first fork structure 150 is coupled to either the first reflector 130 or the first PIFA 140, and both of them can achieve similar levels of performance. It should be noted that the effective area of the first reflector 130 can extend to the first PIFA 140 because of the capacitive effect caused by the first fork structure 150. In the embodiment of FIG. 1A, FIG. 1B, and FIG. 1C, the first fork structure 150 includes a first branch element 151 and a second branch element 152. Both the first branch element 151 and the second branch element 152 are coupled to the edge 131 of the first reflector 130. As shown in FIG. 1B, each of the first branch element 151 and the second branch element 152 is implemented with a metal element which has a straight-line shape. The length L2 of the second branch element 152 is equal to the length L1 of the first branch element 151. A combination of the first branch element 151 and the second branch element 152 substantially has an L-shape, and an intersection point of this L-shape is directly connected to the edge 131 of the first reflector 130. Since the first fork structure 150 is disposed adjacent to the first PIFA 140, an effective capacitor is formed therebetween. When the antenna system 110 operates in the aforementioned high-frequency band, the effective capacitor becomes a short circuit, such that the first PIFA 140 is coupled to the first reflector 130 and is considered as an extension portion of the first reflector 130. Accordingly, there is sufficient reflective area for the first dual-polarized antenna 120, so as to enhance the high-frequency antenna gain of the antenna system 110. On the other hand, when the antenna system 110 operates in the aforementioned low-frequency band, the effective capacitor becomes an open circuit, such that the first PIFA 140 is isolated from the first reflector 130. Using such a design, the radiation energy cannot be transmitted from the first PIFA 140 to the first reflector 130 and its adjacent antenna, and the low-frequency isolation of the antenna system 110 is effectively increased.

In some embodiments, the element sizes of the antenna system 110 are as follows. The total length of the slot 144 of the first PIFA 140 is substantially equal to 0.25 wavelength ($\lambda/4$) of the aforementioned low-frequency band. The total length of each of the first dipole antenna element 121 and the second dipole antenna element 122 of the first dual-polarized antenna 120 is substantially equal to 0.5 wavelength ($\lambda/2$) of the aforementioned high-frequency band. In order to generate constructive interference, the distance D1 between the first reflector 130 and the first dual-polarized antenna 120 (or the second dipole antenna element 122) is slightly longer than 0.25 wavelength ($\lambda/4$) of the aforementioned high-frequency band. The length L1 of the first branch element 151 is from 4 mm to 10 mm, for example, it can be 7 mm. The length L2 of the second branch element 152 is from 4 mm to 10 mm, for example, it can be 7 mm. There is an angle $\theta$ between the first branch element 151 and the second branch element 152. The angle $\theta$ is from 70 to 110 degrees, for example, it can be 90 degrees. The predetermined spacing between the intersection point of the L-shape of the first fork structure 150 and the first PIFA 140 is from 3 mm to 7 mm, for example, it can be 5 mm. Generally, if the length L1 or the length L2 becomes longer, if the angle $\theta$ becomes smaller, or if the predetermined spacing becomes shorter, the effective capacitance between the first fork structure 150 and the first PIFA 140 will be increased. Conversely, if the length L1 or the length L2 becomes shorter, if the angle $\theta$ becomes larger, or if the predetermined spacing becomes longer, the effective capacitance between the first fork structure 150 and the first PIFA 140 will be decreased. The above element sizes are calculated according to many simulation results, and they are arranged for optimizing the gain of all PIFAs of the antenna system 110 and the isolation between the PIFAs. According to the practical measurement, after the first fork structure 150 is added, the isolation between any two PIFAs of the antenna system 110 is increased from about 9.2 dB to about 13.4 dB, and the maximum gain of each PIFA is increased from −2.98 dBi to about −0.27 dBi. Such a design can significantly improve the radiation performance of the antenna system 110.

In some embodiments, the antenna system 110 further includes a second dual-polarized antenna 120-2, a second reflector 130-2, a second PIFA 140-2, and a second fork structure 150-2. The second dual-polarized antenna 120-2 is disposed opposite to or adjacent to the first dual-polarized antenna 120. The second reflector 130-2 is configured to reflect the radiation energy from the second dual-polarized antenna 120-2. The second PIFA 140-2 is separated from the second reflector 130-2. The second fork structure 150-2 is positioned between the second reflector 130-2 and the second PIFA 140-2, and is coupled to the second reflector 130-2 or the second PIFA 140-2. The structures and functions of the second dual-polarized antenna 120-2, the second reflector 130-2, the second PIFA 140-2, and the second fork structure 150-2 are the same as those of the first dual-polarized antenna 120, the first reflector 130, the first PIFA 140, and the first fork structure 150, and the only difference is that they are arranged facing different directions.

In some embodiments, the antenna system 110 further includes a third dual-polarized antenna 120-3, a third reflector 130-3, a third PIFA 140-3, and a third fork structure 150-3. The third dual-polarized antenna 120-3 is disposed opposite to or adjacent to the first dual-polarized antenna 120. The third reflector 130-3 is configured to reflect the radiation energy from the third dual-polarized antenna 120-3. The third PIFA 140-3 is separated from the third reflector 130-3. The third fork structure 150-3 is positioned between the third reflector 130-3 and the third PIFA 140-3, and is coupled to the third reflector 130-3 or the third PIFA 140-3. The structures and functions of the third dual-polarized antenna 120-3, the third reflector 130-3, the third PIFA 140-3, and the third fork structure 150-3 are the same as those of the first dual-polarized antenna 120, the first reflector 130, the first PIFA 140, and the first fork structure 150, and the only difference is that they are arranged facing different directions.

In some embodiments, the antenna system 110 further includes a fourth dual-polarized antenna 120-4, a fourth reflector 130-4, a fourth PIFA 140-4, and a fourth fork structure 150-4. The fourth dual-polarized antenna 120-4 is disposed opposite to or adjacent to the first dual-polarized antenna 120. The fourth reflector 130-4 is configured to reflect the radiation energy from the fourth dual-polarized antenna 120-4. The fourth PIFA 140-4 is separated from the fourth reflector 130-4. The fourth fork structure 150-4 is positioned between the fourth reflector 130-4 and the fourth PIFA 140-4, and is coupled to the fourth reflector 130-4 or the fourth PIFA 140-4. The structures and functions of the fourth dual-polarized antenna 120-4, the fourth reflector 130-4, the fourth PIFA 140-4, and the fourth fork structure 150-4 are the same as those of the first dual-polarized antenna 120, the first reflector 130, the first PIFA 140, and the first fork structure 150, and the only difference is that they are arranged facing different directions.

Please refer to FIG. 1A, FIG. 1B, and FIG. 1C again. The first dual-polarized antenna 120, the second dual-polarized antenna 120-2, the third dual-polarized antenna 120-3, and the fourth dual-polarized antenna 120-4 are arranged symmetrically with respect to their central point 190. Each of the first dual-polarized antenna 120, the second dual-polarized antenna 120-2, the third dual-polarized antenna 120-3, and the fourth dual-polarized antenna 120-4 covers a 90-degree spatial angle. Similarly, the first reflector 130, the second reflector 130-2, the third reflector 130-3, the fourth reflector 130-4, the first PIFA 140, the second PIFA 140-2, the third PIFA 140-3, the fourth PIFA 140-4, the first fork structure 150, the second fork structure 150-2, the third fork structure 150-3, and the fourth fork structure 150-4 are also arranged symmetrically with respect to their central point 190. The first PIFA 140, the second PIFA 140-2, the third PIFA 140-3, and the fourth PIFA 140-4 can cover the same low-frequency band (e.g., from 746 MHz to 894 MHz). The first dual-polarized antenna 120, the second dual-polarized antenna 120-2, the third dual-polarized antenna 120-3, and the fourth dual-polarized antenna 120-4 cover the same high-frequency band (e.g., from 1710 MHz to 2360 MHz). In some embodiments, the antenna system 110 is a beam switching antenna assembly for using all of the first PIFA 140, the second PIFA 140-2, the third PIFA 140-3, and the fourth PIFA 140-4 at the same time, so as to perform low-frequency signal reception and transmission. The beam switching antenna assembly is further arranged for selectively using at least two of the first dual-polarized antenna 120, the second dual-polarized antenna 120-2, the third dual-polarized antenna 120-3, and the fourth dual-polarized antenna 120-4, so as to perform high-frequency signal reception and transmission. For example, when reception signals come from a variety of directions, the antenna system 110 can enable only two dual-polarized antennas toward the direction of maximum signal strength, and disable other dual-polarized antennas. It should be understood that, although there are exactly four dual-polarized antennas and four PIFAs displayed in FIG. 1A, FIG. 1B, and FIG. 1C, in fact, the antenna system 110 may include more or fewer antennas. For example, the antenna system 110 may include one or more of the first dual-polarized antenna 120, the second dual-polarized antenna 120-2, the third dual-polarized antenna 120-3, and the fourth dual-polarized antenna 120-4, and/or one or more of the first PIFA 140, the second PIFA 140-2, the third PIFA 140-3, and the fourth PIFA 140-4. Generally, if the antenna system 110 includes N dual-polarized antennas and N PIFAs (e.g., N may be an integer greater than or equal to 2), the N dual-polarized antennas and the N PIFAs are arranged on the same circumference at equal intervals, and each minor arc between any two adjacent dual-polarized antennas or any two adjacent PIFAs has 360/N degrees.

Figure 2:
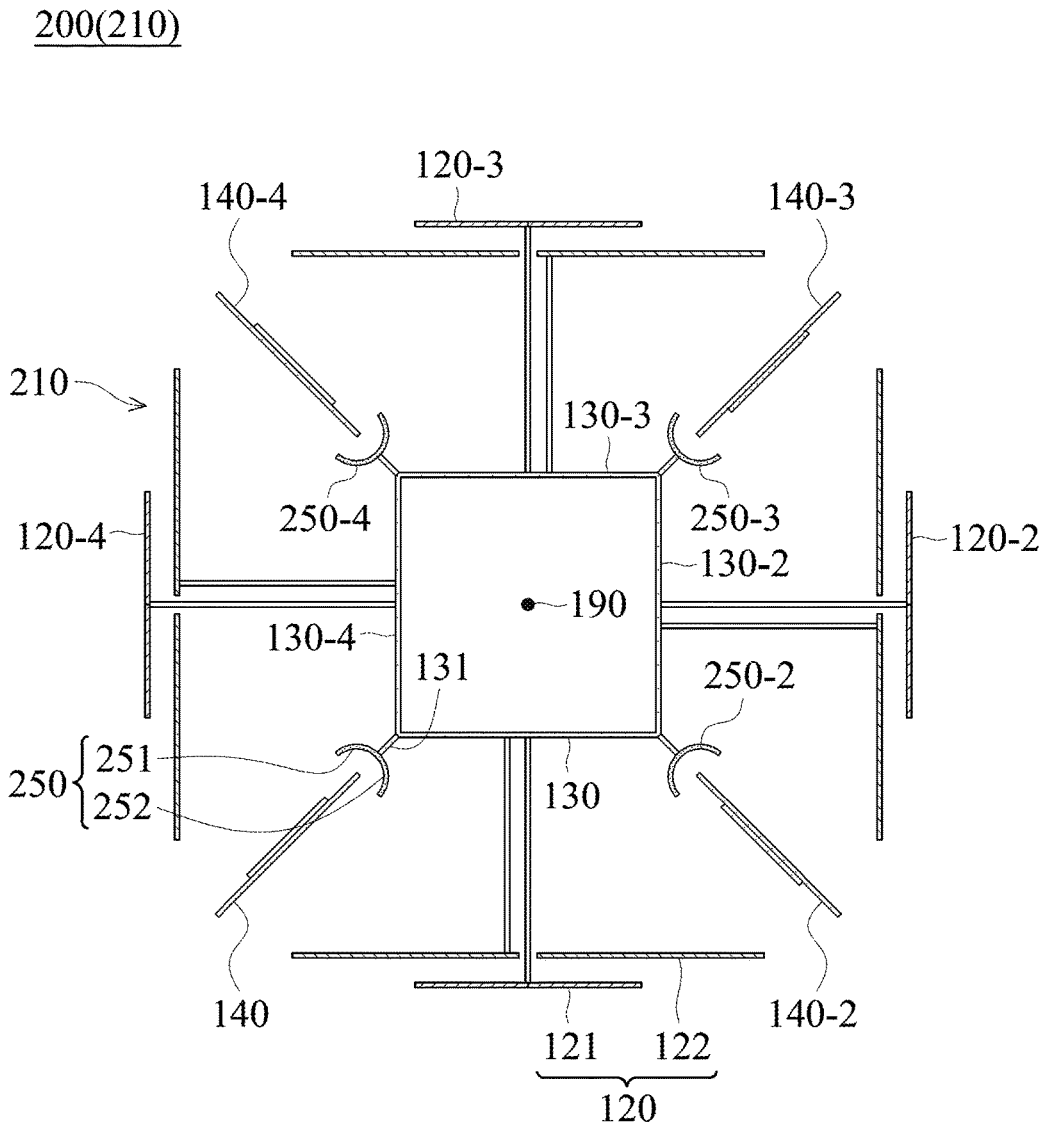
FIG. 2 is a top view of a communication device according to an embodiment of the invention.

FIG. 2 is a top view of the communication device 200 according to an embodiment of the invention. FIG. 2 is similar to FIG. 1B. In the embodiment of FIG. 2, an antenna system 210 of the communication device 200 includes at least one of a first fork structure 250, a second fork structure 250-2, a third fork structure 250-3, and a fourth fork structure 250-4. For example, the first fork structure 250 may include a first branch element 251 and a second branch element 252. Both the first branch element 251 and the second branch element 252 may be coupled to the edge 131 of the first reflector 130. A combination of the first branch element 251 and the second branch element 252 may have an arc-shape. An effective capacitor may be formed between the first fork structure 250 and the first PIFA 140. The second fork structure 250-2, the third fork structure 250-3, and the fourth fork structure 250-4 are the same as the first fork structure 250, but they are arranged facing different directions. Other features of the communication device 200 of FIG. 2 are similar to those of the communication device 100 of FIG. 1A, FIG. 1B, and FIG. 1C. Accordingly, the two embodiments can achieve similar levels of performance.

Figure 3:
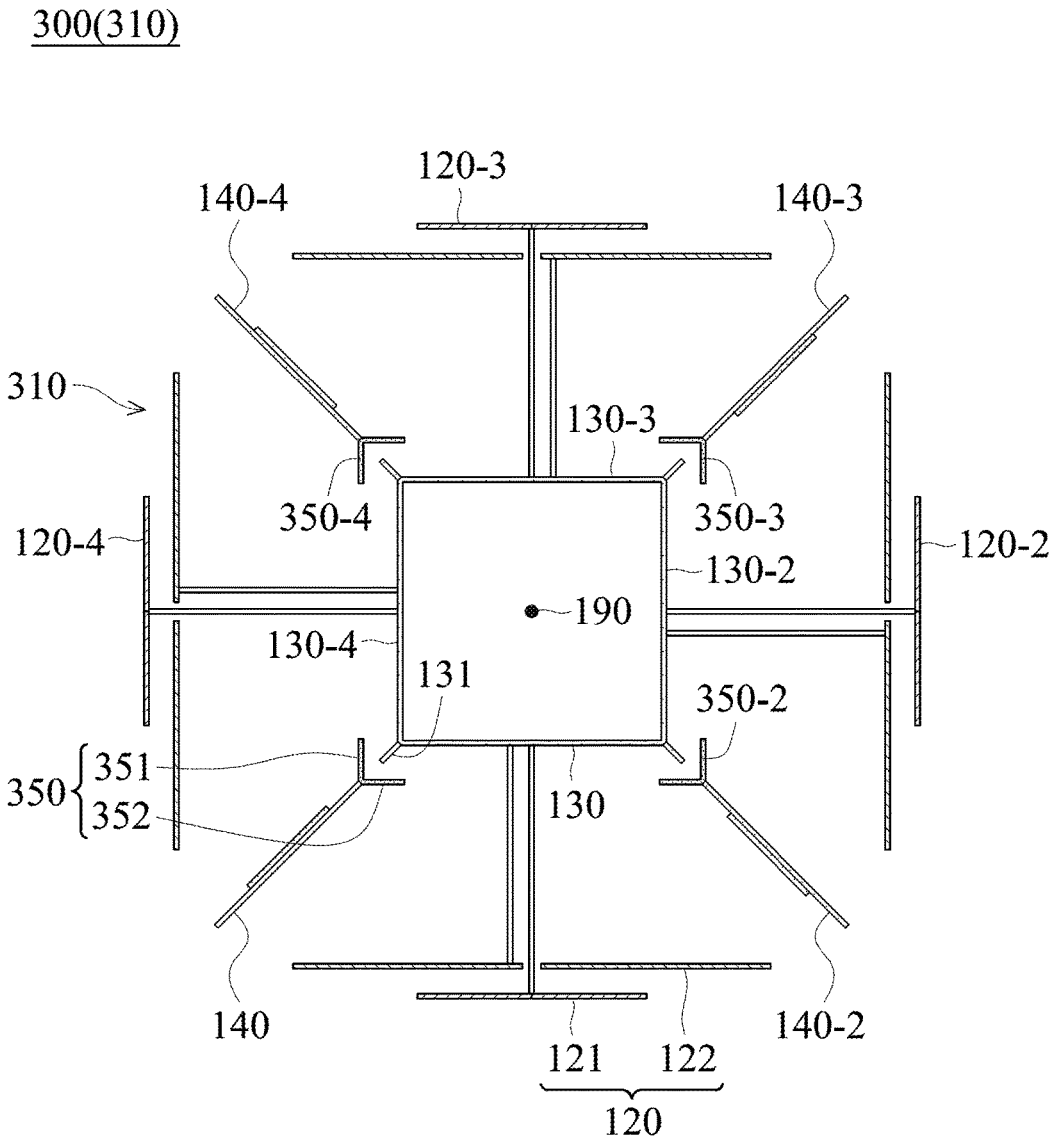
FIG. 3 is a top view of a communication device according to an embodiment of the invention.

FIG. 3 is a top view of the communication device 300 according to an embodiment of the invention. FIG. 3 is similar to FIG. 1B. In the embodiment of FIG. 3, an antenna system 310 of the communication device 300 includes at least one of a first fork structure 350, a second fork structure 350-2, a third fork structure 350-3, and a fourth fork structure 350-4. For example, the first fork structure 350 may include a first branch element 351 and a second branch element 352. Both the first branch element 351 and the second branch element 352 may be coupled to the grounding element 142 of the first PIFA 140. A combination of the first branch element 351 and the second branch element 352 may have an L-shape or an arc-shape. An effective capacitor may be formed between the first fork structure 350 and the edge 131 of the first reflector 130. The second fork structure 350-2, the third fork structure 350-3, and the fourth fork structure 350-4 are the same as the first fork structure 350, but they are arranged facing different directions. Other features of the communication device 300 of FIG. 3 are similar to those of the communication device 100 of FIG. 1A, FIG. 1B, and FIG. 1C. Accordingly, the two embodiments can achieve similar levels of performance.

Figure 4:
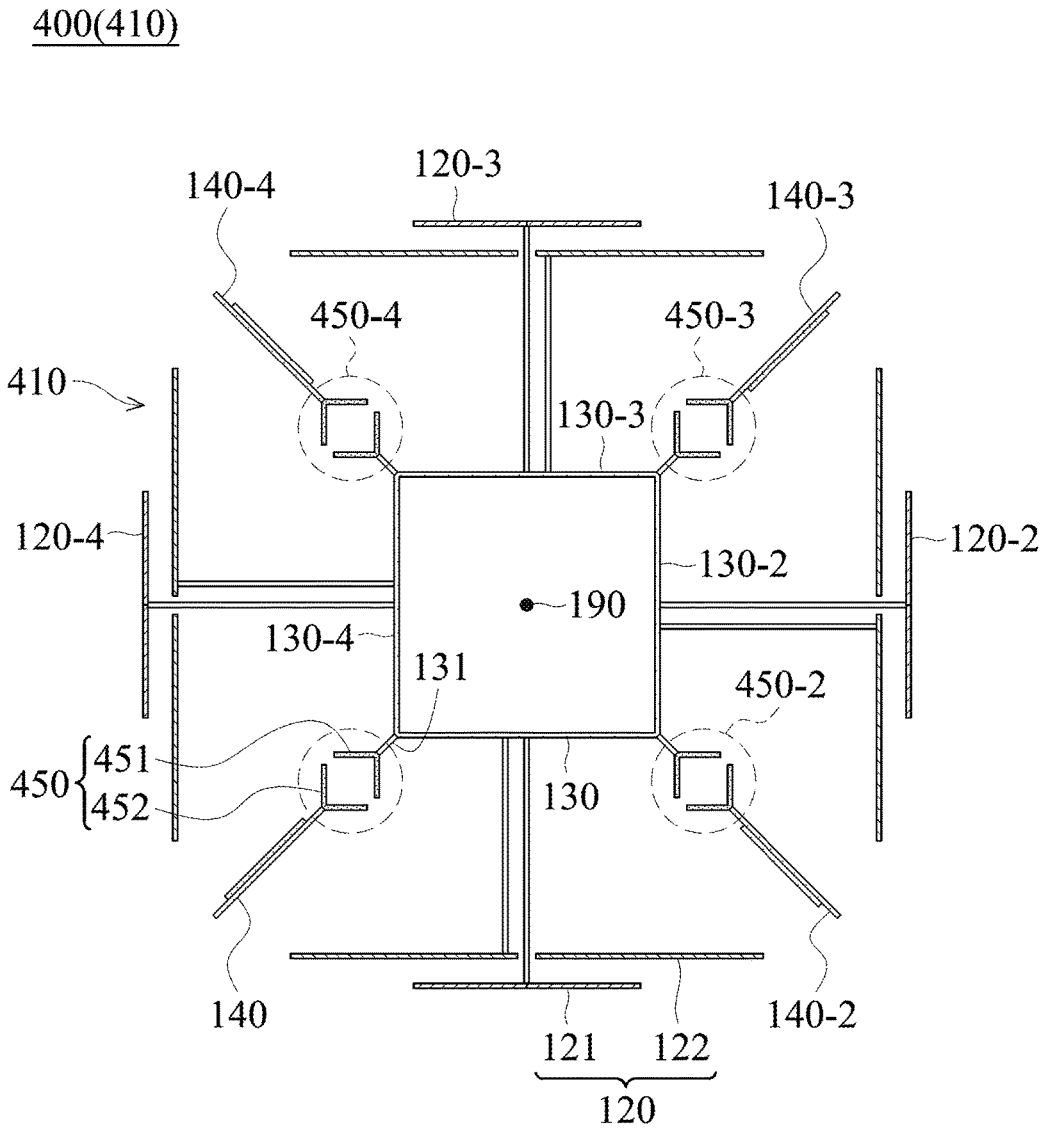
FIG. 4 is a top view of a communication device according to an embodiment of the invention.

FIG. 4 is a top view of the communication device 400 according to an embodiment of the invention. FIG. 4 is similar to FIG. 1B. In the embodiment of FIG. 4, an antenna system 410 of the communication device 400 includes at least one of a first double-fork structure 450, a second double-fork structure 450-2, a third double-fork structure 450-3, and a double-fourth fork structure 450-4. For example, the first double-fork structure 450 may include a first portion 451 and a second portion 452. Each of the first portion 451 and the second portion 452 of the first double-fork structure 450 may be a single-fork structure. The first portion 451 and the second portion 452 of the first double-fork structure 450 may be separated from each other. The first portion 451 of the first double-fork structure 450 may be coupled to the edge 131 of the first reflector 130. The second portion 452 of the first double-fork structure 450 may be coupled to the grounding element 142 of the first PIFA 140. Each of the first portion 451 and the second portion 452 of the first double-fork structure 450 may have an L-shape or an arc-shape. An effective capacitor may be formed between the first portion 451 and the second portion 452 of the first double-fork structure 450. The second double-fork structure 450-2, the third double-fork structure 450-3, and the fourth double-fork structure 450-4 are the same as the first fork structure 450, but they are arranged facing different directions. Other features of the communication device 400 of FIG. 4 are similar to those of the communication device 100 of FIG. 1A, FIG. 1B, and FIG. 1C. Accordingly, the two embodiments can achieve similar levels of performance.

Figure 5:
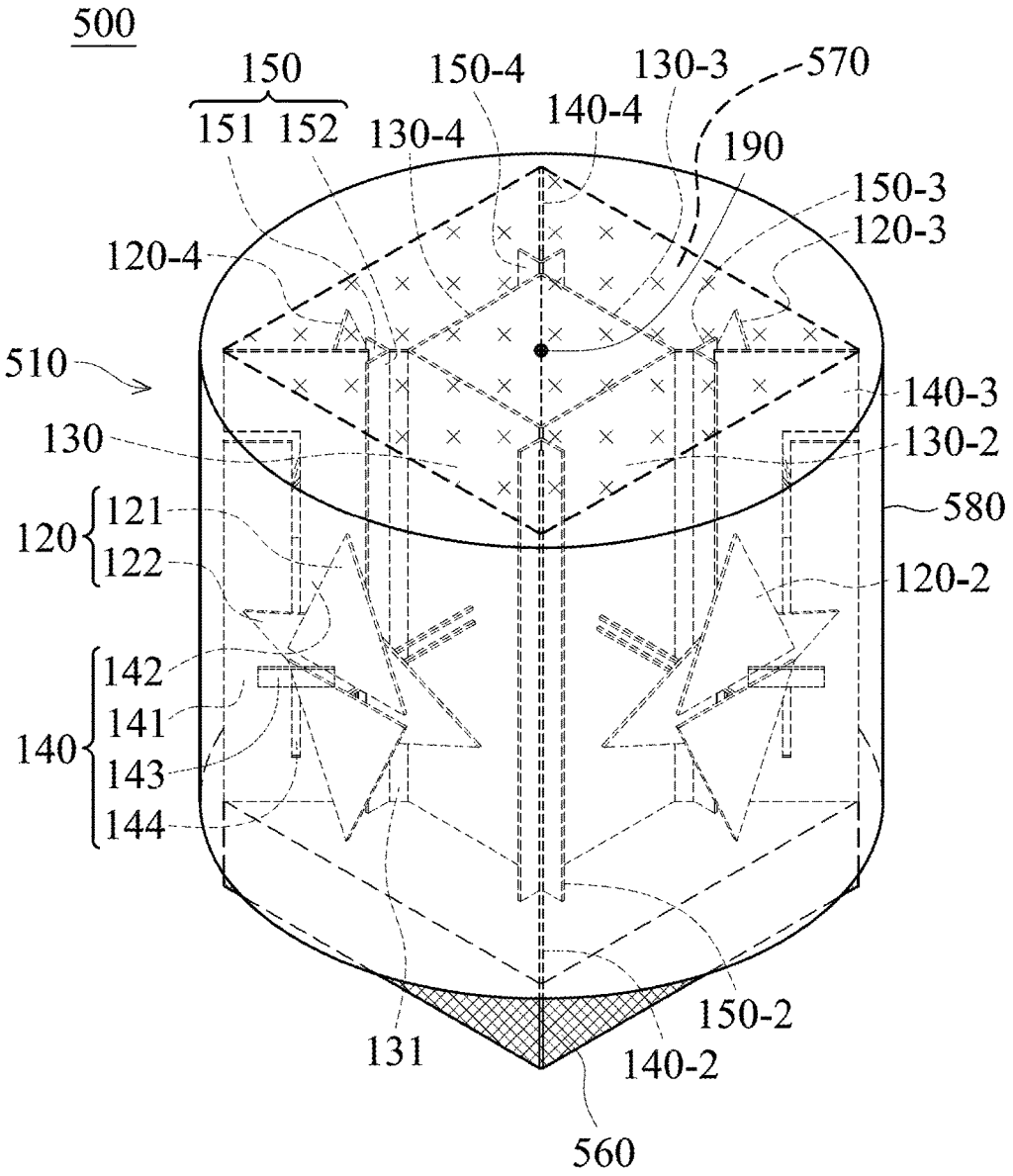
FIG. 5 is a perspective view of a communication device according to an embodiment of the invention.

FIG. 5 is a perspective view of the communication device 500 according to an embodiment of the invention. FIG. 5 is similar to FIG. 1A. In the embodiment of FIG. 5, the communication device 500 further includes a metal elevating pillar 560, a top reflective plate 570, and a nonconductive antenna cover (radome) 580. The metal elevating pillar 560 is coupled to the first reflector 130, the second reflector 130-2, the third reflector 130-3, and the fourth reflector 130-4. The metal elevating pillar 560 may have a hollow structure for accommodating a variety of electronic circuit elements, such as a processor, an antenna switching module, and a matching circuit. The metal elevating pillar 560 is configured to support an antenna system 510 of the communication device 500. The top reflective plate 570 is coupled to the first reflector 130, the second reflector 130-2, the third reflector 130-3, and the fourth reflector 130-4. The top reflective plate 570 is perpendicular to the first reflector 130, the second reflector 130-2, the third reflector 130-3, and the fourth reflector 130-4. The top reflective plate 570 is configured to reflect the radiation toward the zenith direction, so as to enhance the antenna gain of the antenna system 510. The nonconductive antenna cover 580 has a hollow structure (e.g., a hollow circular cylinder or a hollow square cylinder, which has a top lid but no bottom lid). The antenna system 510 and the top reflective plate 570 are both completely inside the nonconductive antenna cover 580. The nonconductive antenna cover 580 is configured to protect the antenna system 510 from interference from the environment. For example, the nonconductive antenna cover 580 may have waterproofing and sun-protection functions.

Figure 6:
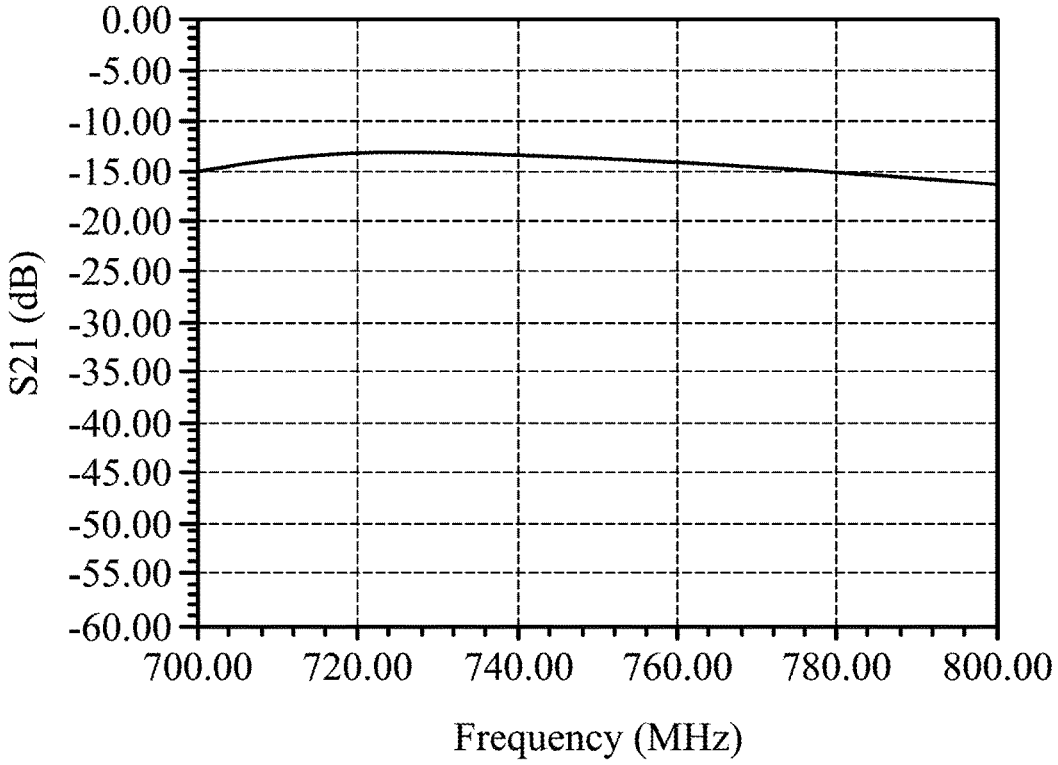
FIG. 6 is a diagram of S parameter of a PIFA (Planar Inverted F Antenna) of an antenna system of a communication device operating in a low-frequency band according to an embodiment of the invention.

FIG. 6 is a diagram of S parameter of the PIFA of the antenna system 510 of the communication device 500 operating in the low-frequency band according to an embodiment of the invention. The horizontal axis represents the operation frequency (MHz), and the vertical axis represents the S21 parameter (dB). In the embodiment of FIG. 6, the first PIFA 140 is set as a first port (Port 1), and its adjacent second PIFA 140-2 or fourth PIFA 140-4 is set as a second port (Port 2). According to the measurement in FIG. 6, in the aforementioned low-frequency band, the isolation between two adjacent PIFAs (i.e., the absolute value of the S21 parameter) is at least about 13.6 dB. The antenna gain of each PIFA is increased due to the increase of the isolation, and it can meet the requirements of practical application of general MIMO (Multi-Input and Multi-Output) antenna systems.

The invention proposes a communication device whose antenna system has the advantages of high isolation and high antenna gain. The invention is suitable for application in a variety of indoor environments, so as to solve the problem of poor communication quality due to signal reflection and multipath fading in conventional designs.

Note that the above element sizes, element parameters, element shapes, and frequency ranges are not limitations of the invention. An antenna designer can fine-tune these settings or values according to different requirements. It should be understood that the communication device and antenna system of the invention are not limited to the configurations of FIGS. 1-6. The invention may merely include any one or more features of any one or more embodiments of FIGS. 1-6. In other words, not all of the features displayed in the figures should be implemented in the communication device and antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

an antenna system, comprising:

a first dual-polarized antenna;

a first reflector, configured to reflect radiation energy from the first dual-polarized antenna;

a first PIFA (Planar Inverted F Antenna), separated from the first reflector; and a first fork structure, positioned between the first reflector and the first PIFA, and coupled to the first reflector or the first PIFA.

2. The communication device as claimed in claim 1, wherein the first PIFA covers a low-frequency band from 746 MHz to 894 MHz, and the first dual-polarized antenna covers a high-frequency band from 1710 MHz to 2360 MHz.

3. The communication device as claimed in claim 1, wherein the first dual-polarized antenna comprises a first dipole antenna element and a second dipole antenna element, and the first dipole antenna element and the second dipole antenna element are perpendicular to each other.

4. The communication device as claimed in claim 1, wherein the first reflector has a pyramidal shape with a wide top opening and a narrow bottom plate, and the wide top opening of the first reflector faces the first dual-polarized antenna.

5. The communication device as claimed in claim 1, wherein the first PIFA comprises a radiation element, a grounding element, and a feeding element, and wherein a slot is formed between the radiation element and the grounding element.

6. The communication device as claimed in claim 5, wherein the feeding element extends across the slot and is coupled to the radiation element.

7. The communication device as claimed in claim 5, wherein the slot substantially has an L-shape.

8. The communication device as claimed in claim 1, wherein the first fork structure comprises a first branch element and a second branch element, and wherein both the first branch element and the second branch element are coupled to an edge of the first reflector or the first PIFA.

9. The communication device as claimed in claim 8, wherein a length of the second branch element is equal to a length of the first branch element.

10. The communication device as claimed in claim 8, wherein a combination of the first branch element and the second branch element substantially has an L-shape or an arc-shape.

11. The communication device as claimed in claim 8, wherein an angle between the first branch element and the second branch element is from 70 to 110 degrees.

12. The communication device as claimed in claim 1, wherein the first fork structure is a first double-fork structure which comprises a first portion and a second portion separated from each other, the first portion is coupled to an edge of the first reflector, and the second portion is coupled to the first PIFA.

13. The communication device as claimed in claim 1, wherein the antenna system further comprises a second dual-polarized antenna, a second reflector, a second PIFA, and a second fork structure, the second reflector is configured to reflect radiation energy from the second dual-polarized antenna, the second PIFA is separated from the second reflector, and the second fork structure is positioned between the second reflector and the second PIFA, and is coupled to the second reflector or the second PIFA.

14. The communication device as claimed in claim 13, wherein the antenna system further comprises a third dual-polarized antenna, a third reflector, a third PIFA, and a third fork structure, the third reflector is configured to reflect radiation energy from the third dual-polarized antenna, the third PIFA is separated from the third reflector, and the third fork structure is positioned between the third reflector and the third PIFA, and is coupled to the third reflector or the third PIFA.

15. The communication device as claimed in claim 14, wherein the antenna system further comprises a fourth dual-polarized antenna, a fourth reflector, a fourth PIFA, and a fourth fork structure, the fourth reflector is configured to reflect radiation energy from the fourth dual-polarized antenna, the fourth PIFA is separated from the fourth reflector, and the fourth fork structure is positioned between the fourth reflector and the fourth PIFA, and is coupled to the fourth reflector or the fourth PIFA.

16. The communication device as claimed in claim 15, wherein the first dual-polarized antenna, the second dual-polarized antenna, the third dual-polarized antenna, and the fourth dual-polarized antenna are arranged symmetrically with respect to their central point, and each of them covers a 90-degree spatial angle.

17. The communication device as claimed in claim 15, wherein the antenna system is a beam switching antenna assembly for selectively using any two of the first dual-polarized antenna, the second dual-polarized antenna, the third dual-polarized antenna, and the fourth dual-polarized antenna to perform signal reception and transmission.

18. The communication device as claimed in claim 15, further comprising:

a metal elevating pillar, coupled to the first reflector, the second reflector, the third reflector, and the fourth reflector, wherein the metal elevating pillar is configured to support the antenna system.

19. The communication device as claimed in claim 15, further comprising:

a top reflective plate, coupled to the first reflector, the second reflector, the third reflector, and the fourth reflector, wherein the top reflective plate is perpendicular to the first reflector, the second reflector, the third reflector, and the fourth reflector.

20. The communication device as claimed in claim 19, further comprising:

a nonconductive antenna cover, having a hollow structure, wherein the antenna system and the top reflective plate are both disposed inside the nonconductive antenna cover.

* * * * *